US005322646A

United States Patent [19]

Wright et al.

[11] Patent Number: 5,322,646

[45] Date of Patent: Jun. 21, 1994

[54] SIMULATED TORNADO HUMIDIFIER

[75] Inventors: Lloyd F. Wright; Mark A. Logan, both of Pleasant Valley, N.Y.

[73] Assignee: Amazing Things, LaGrangeville, N.Y.

[21] Appl. No.: 100,955

[22] Filed: Aug. 3, 1993

[51] Int. Cl.[5] ..... B01F 3/04

[52] U.S. Cl. ..... 261/79.2; 261/DIG. 48

[58] Field of Search ..... 261/79.1, 79.2, DIG. 48

[56] References Cited

U.S. PATENT DOCUMENTS

| | | | |
|---|---|---|---|
| 3,236,031 | 2/1966 | Bennett et al. | 261/79.2 |
| 3,589,044 | 6/1971 | Morrison et al. . | |
| 3,811,663 | 5/1974 | Sterlini | 261/79.2 |
| 4,157,368 | 6/1979 | Fernandes | 261/79.2 |
| 4,241,877 | 12/1980 | Hughes . | |
| 4,251,241 | 2/1981 | Bothun | 261/79.2 |
| 4,258,912 | 3/1981 | Reighart, II . | |
| 4,614,596 | 9/1986 | Wyness | 261/79.2 |
| 4,726,686 | 2/1988 | Wolf et al. | 261/79.2 |

OTHER PUBLICATIONS

Pamphlet, "Dramatize Classroom Science", Scientific Company, Chicago, Ill., The Science Teacher, Sep. 15, 1964, p. 72.

*Primary Examiner*—Tim Miles

*Attorney, Agent, or Firm*—Townsend and Townsend Khourie and Crew

[57] ABSTRACT

A system for humidifying air while generating a tornado-like air flow pattern highlighted by water aerosol is described. The system includes air flow devices which generate a circular tornado-like air flow, a water aerosol generator, and a means of injecting the water aerosol into the circular air pattern to produce a visible tornado. Air is blown parallel to and within two opposing parabolic plates, creating a circular flow pattern. Air is exhausted out the top of the device at the center point between the plates, creating an updraft. Water aerosol wafts into the bottom of the circular air flow, gets caught in the upwardly spinning air flow, and exits through the top of the device. A model of a tornado is created and maintained. Also, the water aerosol humidifies the air in the room as it exits the device.

22 Claims, 2 Drawing Sheets

SIMULATED TORNADO HUMIDIFIER

BACKGROUND OF THE INVENTION

Man has always been fascinated by weather, especially violent weather. The tornado is the supreme example of violent weather. People of all walks of life are fascinated by tornados and enjoy watching TV news, movies and pictures of them. However, as Benjamin Franklin stated over 200 years ago, "Some people are weatherwise, but most people are otherwise." Very few people have any understanding of how tornados work.

It is desirable to satisfy the fascination people have with tornados by educating and entertaining them with a tornado model on a safe, easy to understand scale. Furthermore, it is desirable to add a practical application to this model by utilizing water aerosol comprising the tornado to humidify the surrounding room air.

Humidifying room air helps to alleviate health ailments associated with extremely dry air, which commonly occurs in homes and businesses located in dry or cold climates. Conventional humidifiers use ultrasonic aerosol generators or thermal evaporators to generate water aerosol which are subsequently blown into the room air.

The present invention provides for the effective display of a small scale tornado-like model while also efficiently humidifying the surrounding room. The present invention also provides for scaling so that a display/-humidifier can be constructed to meet a wide variety of display and humidifying needs. SUMMARY OF THE INVENTION According to the present invention, a system for generating small scale tornado-like air flow patterns is used to deliver water aerosol to room air for the purposes of humidifying the air, while educating the user on the workings of tornadoes and entertaining the user by allowing interaction with the tornado flow.

DETAILED DESCRIPTION OF PREFERRED EMBODIMENTS

Figure 1:
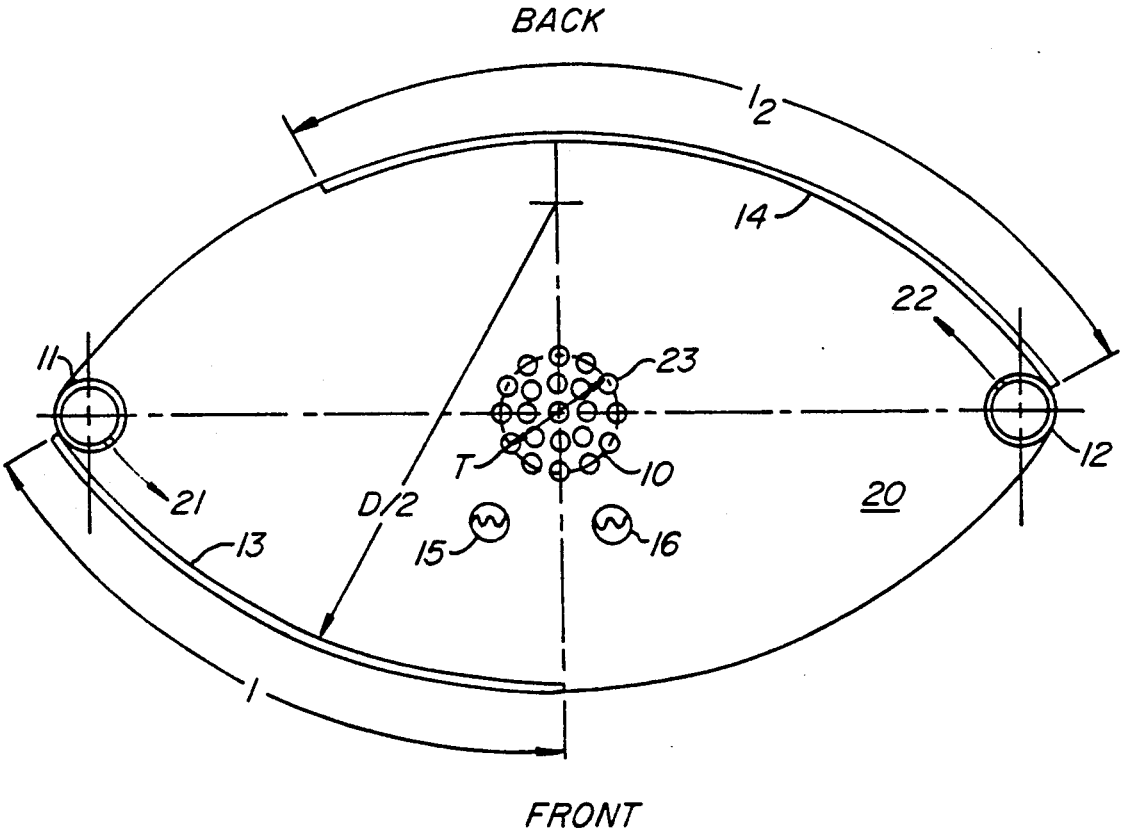
FIG. 1 is a cross-sectional top view of the simulated tornado humidifier according to the present invention.

FIG. 1 illustrates a top view of the chamber of a specific embodiment of the present invention in which a tornado-like air flow pattern, represented by a dashed line 10, is generated by a circular air flow pattern. The circular air flow is created by driving air through perforations 21 and 22 in air distribution tubes 11 and 12. In the chamber the air flow follows the contours of two opposing curved plates 13 and 14, which are mounted on a base 20, to define the boundaries of the chamber. The updraft for the simulated tornado is created by exhausting the resulting rotating column of air out the top with a fan 28 (shown in FIG. 2) at the center point between the two plates 13 and 14. Water aerosol, which is introduced through holes 23 in the base 20, allows the air flow pattern, the spinning aerosol tube, to be visible. Lighting, such as lamps 15 and 16 in the base 20 (or top 30), further highlight the "tornado".

Figure 2:
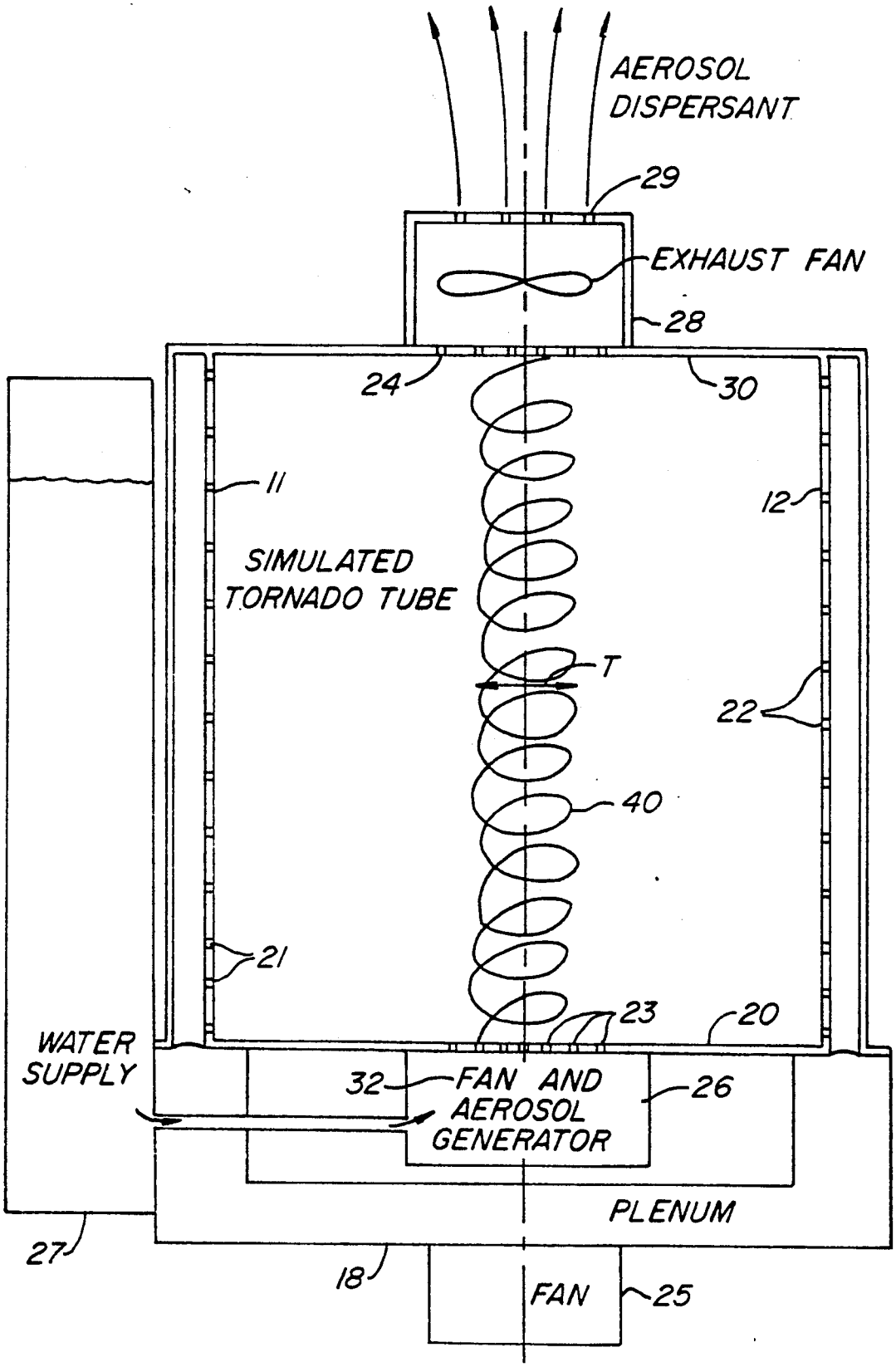
FIG. 2 is a representational side view of a cross-section of the simulated tornado humidifier of FIG. 1.

A representational side view of the simulated tornado humidifier is shown in FIG. 2. The tubes 11 and 12 are connected to an air distribution plenum 18 through which air is forced by a fan 25. The line of perforations 21 of the tube 11 and perforations 22 of the tube 12 are shown. The drawing indicates the placement of the perforations 21 and 22 in the tubes 11 and 12 respectively, to drive the air in one direction or the other viewed vertically. As shown in FIG. 1, the perforations are placed to drive the air column in a counterclockwise direction viewed from the top of the chamber. Of course, the perforations and air foils could also be set up to drive the air column in a clockwise direction. The perforations direct the air generally parallel to the base 20 which includes an optional upward component so that the air is directed upwards at an angle of 30° with respect to the base 20.

An exhaust fan 28 pulls the spinning column of air 40 upwards through an opening, a screen, or holes 24 in an enclosure top 30. The air, laden with moisture, is ejected through exhaust holes 29 into the surrounding atmosphere, thereby humidifying the atmosphere.

The moisture is placed into the air column 40 by an aerosol generator 26 and fan 32 located below the base 20. The aerosol generator, such as an ultrasonic transducer or a water heater, fed by a tank of water 27, generates tiny water particles which are driven through the holes 23 in the base 20 by the fan 32. The aerosol wafts into the center of the circular air flow 40 at the bottom, gets caught in the upwardly spinning air and appears as a simulated tornado of water aerosol.

For dramatic effect the lamps 15 and 16 illuminate the spinning aerosol column 40. As shown in FIG. 1, the lamps 15 and 16 are placed in the front of the chamber for improved illumination. Lamps could be placed in the top 30 of the chamber, or within the location of the holes 23 in the base 20, to light the column 40 internally. The lamps may also be colored. In combination with the coloring of plates 13 and 14, which are transparent plastic, different lighting combinations could generate further dramatic effects.

The opposing plates 13 and 14 may be curved (as seen in a vertical view) in various ways. The plates can be circular (constant curvature), or parabolic or elliptical (varying curvature). Openings into the chamber between the plates 13 and 14 allow interaction with the simulated tornado for amusement. If the rotational velocity of the column 40 is set sufficiently high, one or both of the plates 13 and 14 can even be removed, although the simulated tornado then becomes less stable without the plates.

Thus, using circular plates with radius D/2, the radius may vary from 6 inches to infinity depending on size of simulated tornado and air velocities used. The radial length, $l_1$ and $l_2$, of the plates 13 and 14 can vary from approximately 0 to (3/2)D. In general, it has been found that one of the two plates 13 and 14 should be ($\frac{1}{2}$)D to (3/2)D long, while the other plate should be approximately ($\frac{1}{4}$)D to (3/2)D for optimum operation.

In a "desk-top" version of the simulated tornado humidifier, a standard 5 Watt ultrasonic transducer is used for the aerosol generator 26, a variable speed (6–60 in.$^3$/min.) fan is used for the fan 32 to introduce the water aerosol into the tornado chamber at low velocity and an exhaust fan having a 60 ft.$^3$/min. capacity is used for the exhaust fan 28. An elliptical tornado chamber approximately 9×13 inches is created with two 8-inch radius circular plates, one 8 inches long (radial length) and one 14 inches long and 13 inches high for the plates 13 and 14. One-half inch I.D. inlet tubes are used for the tubes 11 and 12. Air inlet apertures 21 and 22 are created by 12 three-sixteenths inch diameter holes on each tube 11 and 12 evenly spaced one inch apart. With the fan 25, air velocities parallel to the plates 13 and 14 in the range of 0.3—3.0 ft./sec. are achieved. A velocity of approximately 1 ft./sec. seems optimum. Twenty 3/16-inch holes in the chamber top 30 are used for the exhaust holes 24 to create the tornado updraft. Such a humidifier has a simulated tornado tube with a diameter T which can vary ½ inch to 2.5 inches and can humidify a room in the range of 1 to 7 milliliters of water per minute.

This example of the simulated tornado produces a simulated tornado approximately 13 inches high. Direct scaling can lead to a "room-size" tornado approximately 15 feet high and 10 feet in diameter. Any size in between, or smaller or larger, could be produced. Air flow through the two air inlet tubes can be scaled by approximating the tornado as a Rankin combined vortex. See, for example, Blevins, Robert D., *Applied Fluid Dynamics Handbook*, Van Nostrand Reingold Company Inc., New York, 1984. In the core region of a Rankin combined vortex the tangential velocity increases linearly with distance from center, and in the outer region the tangential velocity decreases inversely with the distance from the center. Thus, for a desired tornado radius, r, a desired radius of circular plates, R, the tangential velocity of air at the plates, v, is estimated from empirical data under known conditions as follows:

$$v = v_1 * (r/r_1)^2 * (R_1/R)$$

where $r_1$, $v_1$, and $R_1$ are a known set of conditions on a different scale. The vertical gas velocity (updraft) will scale directly with the tornado diameter.

While the above is a complete description of the preferred embodiments of the invention, various alternatives, modifications and equivalents may be used. It should be evident that the present invention is equally applicable by making appropriate modifications to the embodiments described above. For example, though separate fans are described for driving the air through the plenum and air distribution tubes, for correcting the updraft for the spinning air column and for introducing the aerosol into the air column, a smaller number of fans may be arranged to perform all these functions. Therefore, the above description should not be taken as limiting the scope of the invention which is defined by the metes and bounds of the appended claims.

What is claimed is:

1. A device for creating a tornado-like air flow pattern rising from a base and highlighted by water aerosol, said device comprising:

two air distribution tubes mounted parallel to and displaced from each other on said base, each tube having perforations which inject a flow of air generally parallel to a base surface and in an opposite direction with respect to an air flow from the other tube;

means for generating a water aerosol;

means for introducing said water aerosol through said base into said spinning column; and means for creating an updraft in said spinning air column to exhaust air from said air column;

whereby air exhausted from air column may be used to humidify atmosphere surrounding said device.

2. The device as in claim 1 further comprising a fan and air distribution plenum for supplying air to said air distribution tubes.

3. The device as in claim 1 wherein said updraft creating means comprises a fan.

4. The device as in claim 3 further comprising a top above said air distribution tubes, said top having at least one opening above said spinning air column, and wherein said updraft creating fan exhausts air from said air column through said opening.

5. The device as in claim 1 further comprising at least one curved plate located with respect to said air distribution tubes to direct said air flows from said tubes into a spinning air column.

6. The device as in claim 5 wherein said curved plate has a constant radius.

7. The device as in claim 5 wherein said curved plate has a varying radius.

8. The device as in claim 5 further comprising a second curved plate mounted on said base and located with respect to said air distribution tubes and said at least one curved plate to further direct said air flows from said tubes into a spinning air column.

9. A device for creating a tornado-like air flow pattern over a base, said system comprising:

two air distribution tubes mounted parallel to and displaced from each other on said base, each tube having perforations which inject a flow of air generally parallel to a base surface and in an opposite direction with respect to an air flow from the other tube;

an air distribution plenum for supplying air to said distribution tubes;

a water aerosol generator;

motive means for driving air through said plenum, for creating an updraft in said spinning air column, and for introducing water aerosol from said water aerosol generator into said spinning air column; and lighting means to illuminate said water aerosol in said spinning air column.

10. The device as in claim 9 wherein said lighting means comprises at least one lamp mounted in said base.

11. The device as in claim 9 wherein said motive means comprises a first fan for driving air through said plenum; a second fan for creating an updraft in said spinning air column and a third fan for introducing water aerosol from said water aerosol generator into said spinning air column.

12. The device as in claim 9 further comprising a top over said air distribution tubes, said top having at least one opening between said air distribution tubes and a fan exhausting said air in said spinning air column through said opening to create said updraft.

13. The device as in claim 12 wherein said lighting means comprises at least one lamp mounted in said top.

14. The device as in claim 9 further comprising at least one curved plate located with respect to said air distribution tubes to direct said air flows from said tubes into a spinning air column.

15. The device as in claim 14 wherein said curved plate has a constant curvature.

16. The device as in claim 15 wherein said curved plate has a radius of curvature, said radius in the range from 6 inches to infinity.

17. The device as in claim 14 wherein said curved plate has a varying curvature.

18. The device as in claim 17 wherein said curved plate has a radius of curvature, said radius varying from 6 inches to infinity.

19. The device as in claim 14 wherein said air distribution tubes are displaced from each other by a distance D and said one curved plate has a length along said plate in a direction in a plane containing a line substantially parallel to said distance D, said one curved plate having said length up to (3/2)D.

20. The device as in claim 19 further comprising a second curved plate, said second curved plate located with respect to said air distribution tubes and said one curved plate to further direct said air flows from said tubes into a spinning air column.

21. The device as in claim 20 wherein said second curved plate has a length substantially parallel to said length of said one curved plate, said second curved plate having a length (½)D to 3/2)D long, while the other plate can vary up to (3/2)D.

22. The device as in claim 21 wherein said first curved plate has a length in the range of (½)D to (3/2)D, and said second curved plate has a length of approximately (½)D.

* * * * *